US008167173B1

(12) United States Patent
Simmonds et al.

(10) Patent No.: US 8,167,173 B1
(45) Date of Patent: May 1, 2012

(54) MULTI-STREAM DRAUGHT BEER DISPENSING SYSTEM

(75) Inventors: Scott K. Simmonds, Loveland, CO (US); Michael D. Calvelage, Loveland, CO (US)

(73) Assignee: 3Habto, LLC, Fort Collins, CO (US)

( * ) Notice: Subject to any disclaimer, the term of this patent is extended or adjusted under 35 U.S.C. 154(b) by 888 days.

(21) Appl. No.: 12/176,547

(22) Filed: Jul. 21, 2008

(51) Int. Cl.
*B67D 7/06* (2010.01)

(52) U.S. Cl. ..... 222/144.5; 222/129.1; 222/132; 137/595; 137/625.4; 137/801

(58) Field of Classification Search ..... 222/129.1, 222/132, 144.5, 145.1, 476; 137/801, 595, 137/625.4, 636.1–636.4
See application file for complete search history.

(56) References Cited

U.S. PATENT DOCUMENTS

| | | | | | |
|---|---|---|---|---|---|
| 436,151 | A | * | 9/1890 | Ripley | 222/144.5 |
| 603,465 | A | * | 5/1898 | Dredge et al. | 137/239 |
| 667,301 | A | * | 2/1901 | Dredge | 137/597 |
| 1,047,722 | A | * | 12/1912 | Vergano | 222/42 |
| 1,515,768 | A | * | 11/1924 | Damon | 99/323.2 |
| 1,600,170 | A | * | 9/1926 | Henderson | 222/129.1 |
| 2,675,018 | A | * | 4/1954 | Bender et al. | 137/381 |
| 2,888,040 | A | * | 5/1959 | Terwilliger | 137/635 |
| 5,706,871 | A | | 1/1998 | Anderrson et al. | |
| 5,979,713 | A | | 11/1999 | Grill | |
| 6,053,475 | A | | 4/2000 | Batschied et al. | |
| 6,698,629 | B2 | | 3/2004 | Taylor-McCune | |
| 6,736,159 | B2 | | 5/2004 | Becker | |

* cited by examiner

*Primary Examiner* — J. Casimer Jacyna
(74) *Attorney, Agent, or Firm* — John D. Gugliotta, Pe, Esq.

(57) ABSTRACT

A tap is provided that allows multiple streams of draught beers to be dispersed from one keg handle. The tap has one tap handle, one spigot, at least three fluid streams for connecting to at least three pressurized tanks corresponding with the fluid streams. A floating transfer block functions as a selection valve that aligns with a selected fluid stream no that multiple streams of draught beers to be independently dispersed from said one tap handle.

12 Claims, 5 Drawing Sheets

MULTI-STREAM DRAUGHT BEER DISPENSING SYSTEM

FIELD OF THE INVENTION

The preset invention relates to beer taps, and, more specifically, to a tap that allows multiple streams of draught beers to be dispersed from one tap handle.

BACKGROUND OF THE INVENTION

Competition is fierce for draft beer in liquor venues because of the limited space for keg fonts. In many cases, large distributors, s.a., e.g., Anheuser-Busch, Miller, and Coors, oligopolize the marketplace for keg fonts; hence, sales of lesser known bottled micro-brews are lost to the better known and less-expensive draught beers. A need is long felt for a system that provides greater selection of draft beers utilizing the same keg font space.

A search of the prior art reveals references that teach a single valve that controls, multiple fluid streams: U.S. Pat. No. 5,653,269 to Miller et al. teaches a "method and apparatus for multiple-channel dispensing of natural gas", wherein the dispensing system supports multiple dispensing hoses from a single supply plenum; and, U.S. Pat. No. 5,979,713 to Grill teaches a "tap assembly adapted for a fluid dispenser", wherein a tap is adapted for a fluid mixture dispenser having a source of a first fluid and multiple sources of a second, pressurized fluid.

The present method of dispensing includes a floating transfer block which is moved to align an internal tube with selected fluid streams while it simultaneously seals others. U.S. Pat. No. 5,706,871 to Andersson et al. teaches a "fluid control apparatus and method" in which one valve assembly controls the flow of fluid from multiple sources. More specifically, a single pump serves a plurality of gasoline dispensing nozzles. A member rotates relative to a fixed valve unit with the arrangement being such that the rotation controls the flow of fluid through the assembly. The member is rotated to the position corresponding to the unit actuated.

U.S. Pat. No. 6,053,475 to Batschied et al. teaches a "tap for withdrawing fluid from a container, wherein the tapping process is effected by a rotary motion. An inner tube is guided in an outer tube to slide in an axial direction which can be rotated to let beer be tapped.

The following examples are samples of recently patented taps having novel features: U.S. Pat. No. 6,698,629 to Taylor-McCune teaches a "comestible fluid dispensing tap and method" having a draw-back valve that draws fluid upstream when it is closed; and, U.S. Pat. No. 6,736,159 to Becker teaches a "beverage tap" having a special steel inner part securely pressed with a snug fit. A tubular, steel part of a spout is placed to its side in a liquid-tight matter. A fixture for a ball joint for the shutoff valve is held snuggly to fit to a side by means of a swivel nut.

Consequently, the present invention allows multiple streams of draught beers to be dispensed from one faucet.

SUMMARY OF THE INVENTION

It is an object of the present invention to provide a tap that allows for multiple streams of draught beers to be dispersed from one tap handle.

It is an object that the present invention provides an opportunity to increase draught dispensing by 300%; namely, it is an object that lesser-known micro-brews are able to expand to draught markets that have often excluded them because of a limit to keg font space.

It is an object that the present individual keg fonts not take up additional space at a bar front; rather, multiple fluid stream lines associated with a single tap handle travel to separate, and individual inconspicuous pressurized containers.

It is therefore an object to maximize a selection of draft beer to patrons and thence a same in business opportunities to owners.

The present invention includes a single valve that associates with a shank to control multiple fluid streams. The valve utilizes a floating transfer block which seals off all but a selected fluid stream. When the tap handle selects a draft, the transfer block aligns with the beer stream selected so that beer can travel freely out of the faucet. When the tap handle is rotated from a home (non-flow) position, a rotation mechanism inside the valve allows the transfer block to properly align with the fluid stream associated with the rotation. The tap handle dispenses the beer when it is pulled downwards. The valve is self-clearing so that excess beer left therein is drained to prevent product mixing for a next use.

BRIEF DESCRIPTION OF THE DRAWINGS

Advantages and features of the present invention are better understood with reference to the following and more detailed description and claims taken in conjunction with accompanying drawings, in which like elements are identified with like symbols.

DESCRIPTION OF THE PREFERRED EMBODIMENTS

The best mode for carrying out the invention is presented in terms of its preferred embodiment, herein depicted within the Figures:

1. Detailed Description of the Figures

Figure 1A:
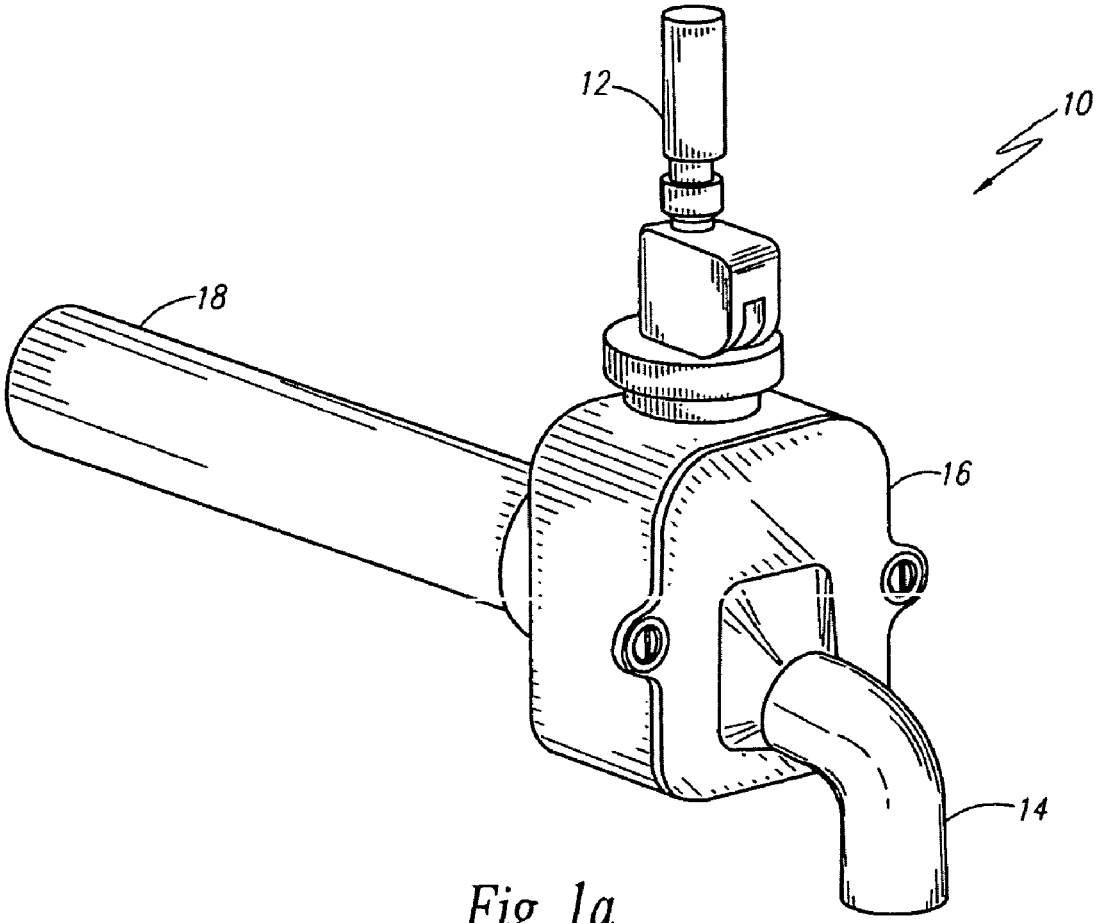
FIG. 1*a* is a front perspective view of a draught beer tap according to a preferred embodiment of the present invention.
Figure 1B:
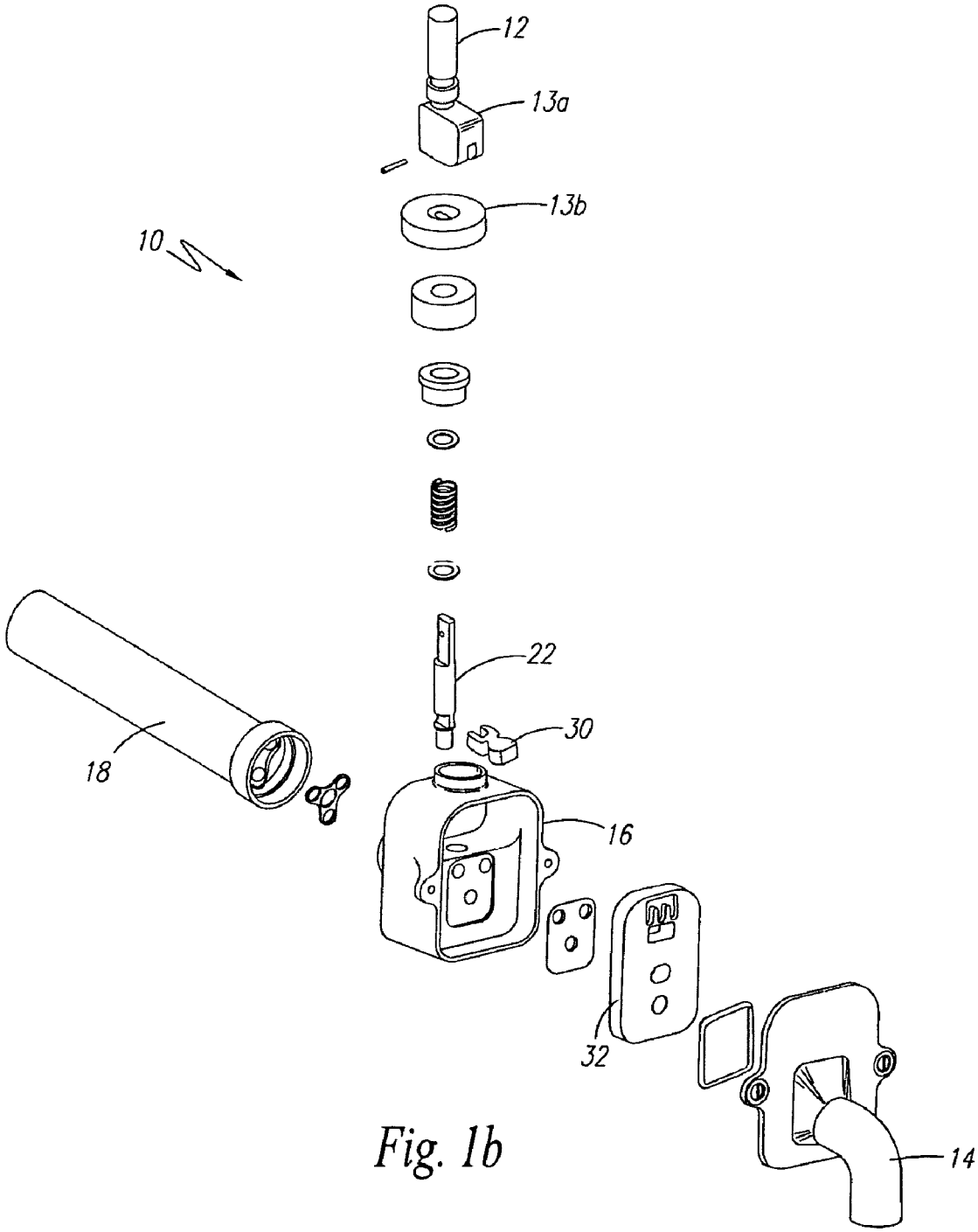
FIG. 1*b* is an exploded view of the draught beer tap of FIG. 1*a*.

FIG. 1*a-b* show a draught beer tap 10 according to a preferred embodiment of the present invention. The exterior appearance of the beer tap 10 is similar to conventional beer taps: it comprises a tap handle 12 and a dispensing spigot 14. Most tap handles are pulled forward to dispense beer and they are replaced back to cease dispensing. The present tap handle 12 operates in a similar manner; however, it can be rotated, twisted, laterally offset or similarly manipulated beforehand to select a draught desired. The selection is made because the present invention is a tap 10 that allows multiple streams of draught beers to be dispensed from one tap handle 12. A valve main body 16 is placed between the tap handle 12 and the spigot 14 to control a flow of the selected draught. A multishank tap inlet 18 extends from a rear of the valve body 16 to house at least three fluid stream tubes (18*a*, 18*b*, third not shown) that travel to respective pressurized keg tanks.

Figure 2A:
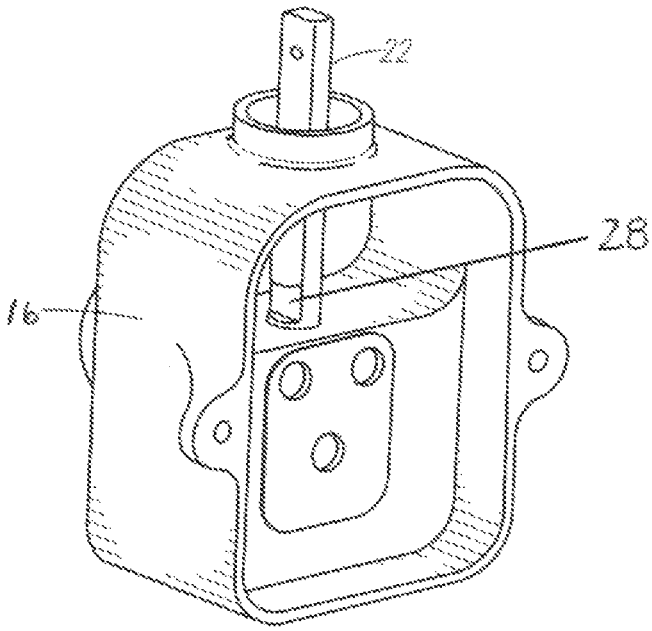
FIG. 2*a* is a front view of an interior of the valve main body with a transfer block.
Figure 2B:
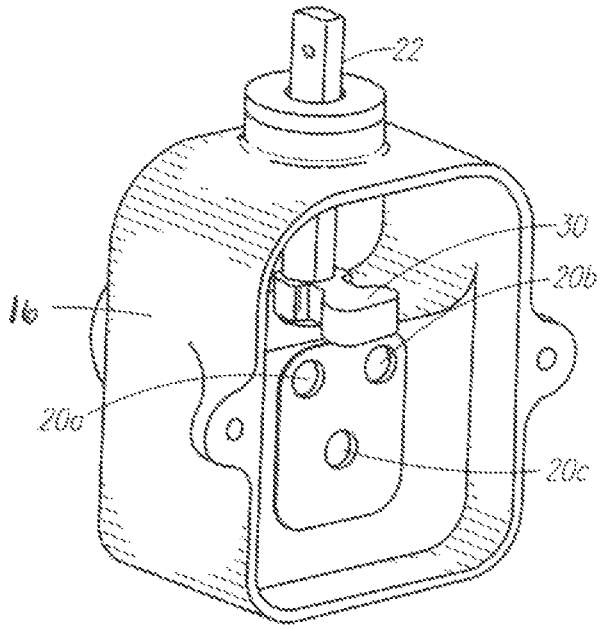
FIG. 2*b* is a front view of an interior of the valve main body, wherein the transfer block cam is assembled therein.
Figure 3:
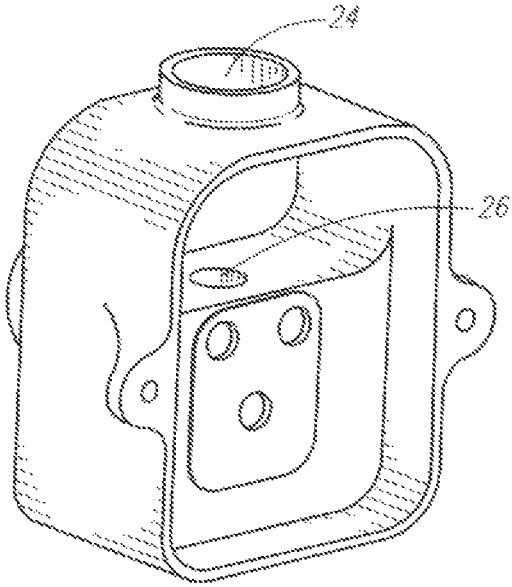
FIG. 3 is a front view of an interior of the valve main body.

An interior of a front of the valve main body 16 is shown in FIGS. 2*a* and 2*b*. A series of at least three fluid ports 20*a*, 20*b*, 20*c* extend horizontally through a solid portion of the main body 16 to serve as draught inlets. The ports 20*a*, 20*b*, 20*c* are spaced such that none are in vertical alignment; however, at least two of the three ports are in horizontal alignment. A shaft 22 to the tap handle 12 travels vertically through a collar 24 (see FIG. 3) at a top of the main body 16 and then through a hollow portion in the body before it terminates in a seat 26 (see FIG. 3) at a top of the solid portion. The solid portion is namely tucked towards a bottom rear of the main body 16 so that there is clearance available for a floating transfer block facing the front. Two opposing channel-grooves 28 (see FIG. 2*a*) in the shaft 22 receive a transfer block cam 30 (see FIG. 2*b*) that extends frontwards therefrom. The transfer block cam 30 is lifted slightly above a top surface of the solid portion.

Figure 4:
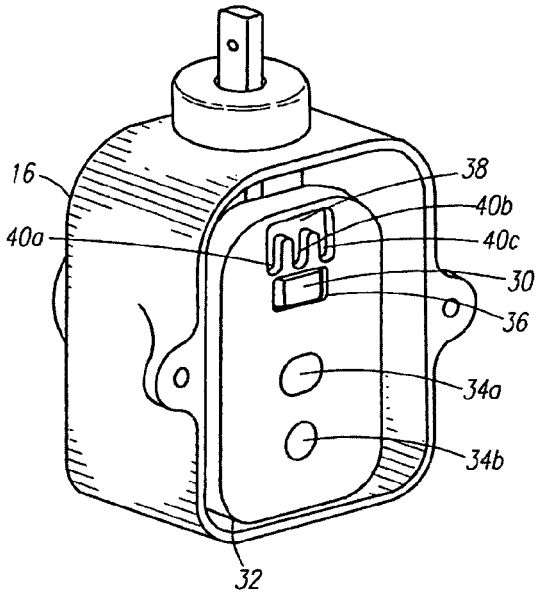
FIG. 4 is a front view of an interior of the valve main body, wherein the transfer block is assembled therein.

The transfer block cam 30 travels through a correspondingly shaped aperture 36 on the transfer block 32. The transfer block 32 feature essentially controls the flow of selected draught because it blocks at least two of the three fluid stream ports 20*a*, 20*b*, 20*c*. FIG. 4 shows the transfer 32 assembled therein. The transfer block 32 comprises vertically aligned apertures 34*a*, 34*b* that correspond to the ports 20*a*, 20*b*, 20*c*. The present transfer block 32 can maintain four positions. In a first position, when the transfer block 32 is farthest right with respect to the valve main body 16, the top aperture 34*a* aligns immediate to a first of the two horizontal ports 20*b*; hence, the transfer block covers and blocks the remaining ports 20*a*, 20*c* while the bottom aperture 34*b* rests immediate to a solid wall of the solid portion. In a second position, when the transfer block 32 is farthest left with respect to the valve main body 16, the top aperture 34*a* aligns immediate to a second of the two horizontal ports 20*a*; hence, the transfer block covers and blocks the remaining ports 20*b*, 20*c* while the bottom aperture 34*b* rests immediate to the solid wall of the solid portion. In a third position, when the transfer block 32 is centered with respect to the valve main body 16, the bottom aperture 34*b* aligns immediate to the lowest port 20*c*; hence, the transfer block covers and blocks the remaining ports 20*a*, 20*b* while the top aperture 34*a* rests immediate to the solid wall of the solid portion. In a fourth and a final position, the transfer block 32 is in an intermediate position, wherein neither the top nor the bottom apertures 34*a*, 34*b* align immediate to any ports 20*a*, 20*b*, 20*c*; hence, the transfer block covers all ports while its apertures both rest immediate to the solid wall. This fourth position is achieved when the tap 12 is in the "home" or "off" position (when the shaft 22 is seated), so that draught beer is blocked from freely flowing out of the faucet 14 at all times. The adjacent abutment of the transfer block 32 to a solid wall of the main body 16 replaces the valve assemblies in conventional draught beer taps.

Figure 5:
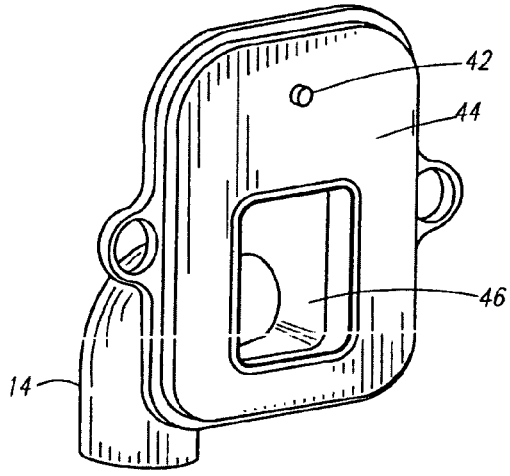
FIG. 5 is a rear view of the front wall of the valve main body.

A uniquely shaped lock-groove 38 provides function to lock the transfer block 32 in the position associated with the selected fluid stream. The lock-groove is shown in the figure to comprise a shape of a downward facing letter "E"; however, it is not limited to any one shape. Each stem 40*a*, 40*b*, 40*c* of the letter is associated with one of the corresponding ports 20*a*, 20*b*, 20*c*. A corresponding indexing pin 42 is fixed to a rear surface of a front wall 44 of the valve main body 16 (shown in FIG. 5). The indexing pin 42 appears to travel about the lock-groove's channels; actually, the transfer block 32 floats to cause the lock-groove 38 to move about the fixed indexing pin. A large window 46 through the front wall 44 allows draft to travel from the ports to the spigot 14.

To move the transfer block 32 to the previously described first position, the lock groove 38 is moved to rest the indexing pin 42 at a bottom of the farthest right stem 40*c*. To move the transfer block 32 to the previously described second position, the lock groove 38 is moved to rest the indexing pin 42 at a bottom of the farthest left stem 40*a*. To move the transfer block 32 to the previously described third position, the lock groove 38 is moved to rest the indexing pin 42 at a bottom of the middle stem 40*b*. To move the transfer block 32 to the forth, "home" position, the lock groove 38 is moved to rest the indexing pin 42 along the horizontal branch of the letter "E" at a top of the lock groove 38.

If the indexing pin 42 were not fixed, such that it rather moved about a fixed lock groove, there would be risk that the pin would anytime fall downwards one of the stems and cause unwanted beer to flow from the faucet, but because the indexing pin 42 is fixed in the present invention, it actually rests in the horizontal branch of the lock groove 38 when the handle 12 of the system 10 is pushed furthest downwards such that its vertical movement is blocked.

It is important that the transfer block 32 has clearance to float vertically and horizontally within the valve main body 16; its length and height dimensions are smaller than those of the main body. The valve main body 16 must comprise a height at least as great as that of the transfer block 32 plus that of the lock groove 38. The valve main body 16 must comprise a length at least as great as that of the transfer block 32 plus that of the lock groove 38.

Figure 6:
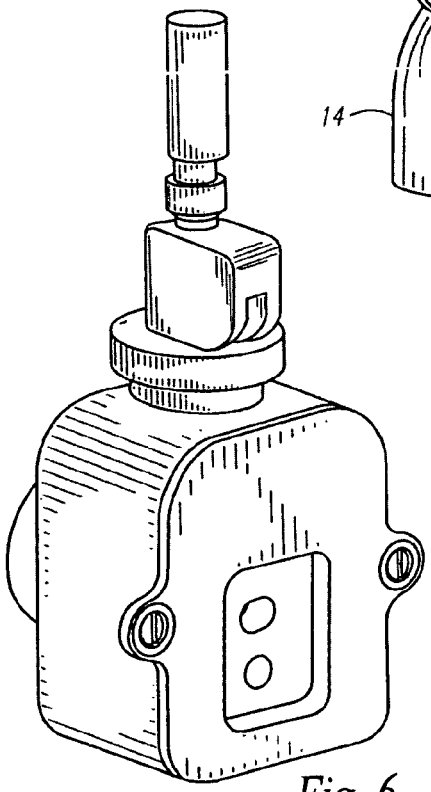
FIG. 6 is a front view of the valve body absent the faucet.
Figure 7:
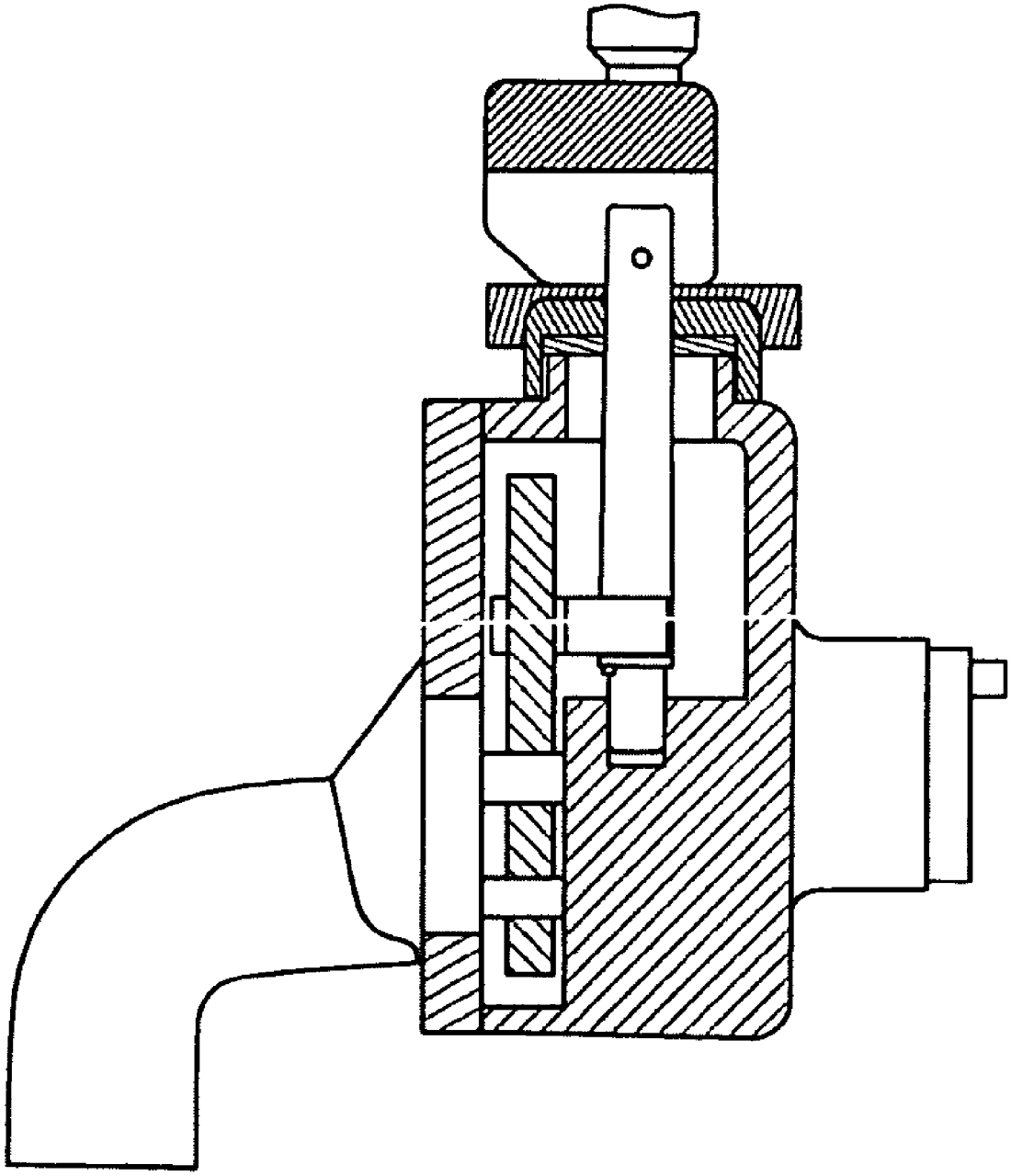
FIG. 7 is a side perspective view of the tap.

FIG. 6 shows the front wall 44 affixed to the valve main body 16 absent the faucet 14. The window 46 comprises a height long enough to expose both of the vertically aligned apertures 34*a*, 34*b* on the transfer block 32; however, one of the two apertures abuts a wall while the other rests immediate to a port 20*a*, 20*b*, 20*c*.

To ensure that different drafts associated with the various ports 20*a*, 20*b*, 20*c* don't mix such that their flavors are compromised, the present invention is self-draining.

When the transfer block 32 is readjusted to a different selection, the beer left in the previous fluid stream empties the port. If the top aperture 34*a* is moved from a first to a second of the horizontal aligned ports 20*a*, 20*b*, the beer for the first is not left stagnant in the short distance of the aperture. The apertures may, for example, be inclined inwards so all remaining beer drains towards the faucet 14.

2. Operation of the Preferred Embodiment

To operate the present embodiment, a first of at least three available drafts is selected. When the draught handle 12 is not in use, it rests in a "home" position and no aperture 34*a*, 34*b* on the transfer block is aligned with a port 20*a*, 20*b*, 20*c*; hence, the internal indexing pin 42 is resting in the horizontal branch of the lock-groove 48. To select a draft (and to internally move the lock-groove 38 about the fixed indexing pin 42), the bar tender rotates the shaft 22 (by means of the handle 12) towards the selected draught. The shaft 22 rotates about the transfer block cam 30, which urges the transfer block 32 to shift horizontally within the main body 16. When the indexing pin 42 aligns with the stem 40*a*, 40*b*, 40*c* associated with the select draft, the bar tender pulls the handle downwards so that the indexing pin can fall to a bottom of the stem and lock the transfer plate aperture 34*a*, 34*b* immediate to the fluid stream port that corresponds with the selection. As the transfer plate 32 is pulled upwards in response to a manipulation of the handle 12, the aperture 34*a*, 34*b* on the transfer plate 32 aligns immediate to a port 20*a*, 20*b*, 20*c*. The shaft 22 is moved from its resting seat while the indexing pin 42 locks the transfer block 32 from moving about. Draught freely flows from the fluid stream outwards the faucet 14. When a glass or a pitcher is filled, the tap handle 12 is pushed upwards such that it is returned to the home position. This causes the transfer block 32 to return to its blocking position and cease a flow of the selected draught. The beer remaining in the aperture to the transfer block 32 self drains and the process is repeated upon a next patron's order.

The foregoing descriptions of specific embodiments of the present invention are presented for purposes of illustration and description only. They are not intended to be exhaustive or to limit the invention to the precise forms disclosed and, obviously, many modifications and variations are possible in light of the above teaching. The embodiments are chosen and described in order to best explain the principles of the invention and its practical application, to thereby enable others skilled in the art to best utilize the invention and the embodiments with various modifications as are suited to the particular use contemplated. It is intended that a scope of the invention be defined by the Claims appended hereto and to their equivalents. Therefore, the scope of the invention is to be limited only by the following claims.

What is claimed is:

1. A multiple draught beer dispensing system, comprising:

one tap handle;

one faucet;

a multishank conduit communicating at least three fluid streams;

at least three pressurized tanks corresponding with said at least three fluid streams;

a valve main body placed between said tap handle and said faucet to control a flow of selected draught, said valve main body forming a hollow portion above a fixed portion, said fixed portion further comprising a fixed transfer block forming at least three apertures, one said aperture corresponding with and in fluid communication with a different one of said at least three fluid streams;

a shaft to said tap handle which travels vertically through a collar at a top of said valve main body and then through the hollow portion in said valve main body before it terminates in a seat at a top of a solid portion of the valve main body; and two opposing channel-grooves in said shaft to receive a transfer block cam that extends front wards therefrom to engage with a floating transfer block capable of lifting said floating transfer block slightly above a top surface of said solid portion of said valve; wherein said system allows multiple streams of draught beers to be independently dispersed from said one tap handle.

2. The dispensing system of claim 1, wherein said transfer block cam travels through a correspondingly shaped aperture on a floating transfer block, said floating transfer block controls a flow of selected draught by all but one fluid stream ports formed by said fixed transfer block.

3. The dispensing system for claim 2, wherein said floating transfer block comprises vertically aligned apertures that correspond to said ports, said floating transfer block maintains at least three position form the group comprising:

a first position, when said floating transfer block is farthest right with respect to said fixed transfer block of said valve main body, a top aperture aligns immediately to a first of two horizontal ports such that said floating transfer block covers and blocks remaining ports while a bottom aperture rests immediately to a solid wall of said fixed transfer block;

a second position, when said transfer block is farthest left with respect to said valve main body, said top aperture aligns immediately to a second of said two horizontal ports such that said floating transfer block covers and blocks said remaining ports while said bottom aperture rests immediate to said solid wall of said fixed transfer block; and a third position, when said transfer block is centered with respect to said valve main body, said bottom aperture aligns immediate to a lowest port such that said floating transfer block covers and blocks said remaining ports while said top aperture rests immediate to said solid wall of said solid portion.

4. The dispensing system of claim 2, further comprising on said floating transfer block a downward facing letter "E" shaped lock-groove which functions to lock said transfer block in a position associated with a selected fluid stream, wherein each stem of said letter "E" is associated with one of said corresponding ports.

5. The dispensing system of claim 4, further comprising a corresponding indexing pin fixed to a rear surface of a front wall of said valve main body, said floating transfer block causes said lock-groove to move about said indexing pin.

6. The dispensing system of claim 5, further comprising a large window through said front wall to allow said selected draught to travel from said ports to said faucet.

7. The dispensing system of claim 6, wherein said window comprises a height long enough to expose both of said vertically aligned apertures on said transfer block.

8. The dispensing system of claim 1, wherein said system is self draining such that when a transfer block readjusts to a different selection, beer left in one of said at least three fluid streams empties.

9. The dispensing system of claim 1, wherein said tap handle can be rotated, twisted, laterally offset or similarly manipulated to select a draught desired.

10. The dispensing system of claim 9, further comprising a tubular tap inlet extending from a rear of said valve main body to house said at least three fluid streams.

11. The dispensing system of claim 10, further comprising a series of at least three fluid ports extending horizontally through a solid portion of said valve main body to serve as draught inlets.

12. The dispensing system of claim 11, wherein said ports are spaced such that none are in vertical alignment, but at least two of said three ports are in horizontal alignment.

* * * * *